US010113361B2

(12) United States Patent
Cheng et al.

(10) Patent No.: US 10,113,361 B2
(45) Date of Patent: Oct. 30, 2018

(54) SAFETY MECHANICAL BARRIER AND SYSTEM FOR ABOVE-GROUND POOL LADDERS

(71) Applicant: POLYGROUP MACAU LIMITED (BVI), Road Town, Tortola (VG)

(72) Inventors: Elmer Cheng, Midlevel (HK); Victor Ocegueda, Baja California (MX); Dong Sheng Xu, Xihua (CN)

(73) Assignee: POLYGROUP MACAU LIMITED (BVI), Road Town (VG)

( * ) Notice: Subject to any disclaimer, the term of this patent is extended or adjusted under 35 U.S.C. 154(b) by 167 days.

(21) Appl. No.: 14/963,707

(22) Filed: Dec. 9, 2015

(65) Prior Publication Data

US 2016/0160562 A1 Jun. 9, 2016

Related U.S. Application Data

(60) Provisional application No. 62/089,495, filed on Dec. 9, 2014.

(51) Int. Cl.

| | |
|---|---|
| ***E04H 5/00*** | (2006.01) |
| ***E05C 3/02*** | (2006.01) |
| ***E04G 3/00*** | (2006.01) |
| ***E06C 7/00*** | (2006.01) |
| ***E04H 4/14*** | (2006.01) |
| ***E06C 1/26*** | (2006.01) |

(52) U.S. Cl.
CPC ..... *E06C 7/006* (2013.01); *E04H 4/144* (2013.01); *E06C 1/26* (2013.01)

(58) Field of Classification Search
CPC ..... E06C 7/006
USPC ..... 4/504; 292/213–218; 248/214, 218.4, 248/226.11, 228.5, 210
See application file for complete search history.

(56) References Cited

U.S. PATENT DOCUMENTS

| | | | | |
|---|---|---|---|---|
| 1,429,389 A * | 9/1922 | Weintz | A01K 1/0017 | 292/216 |
| 3,225,863 A * | 12/1965 | Ludlow | E06C 7/006 | 182/104 |
| 2003/0127851 A1* | 7/2003 | Guslick | F16L 23/06 | 285/112 |
| 2013/0031841 A1* | 2/2013 | Naranjo | E06C 7/00 | 49/463 |
| 2014/0333036 A1* | 11/2014 | Kullen | F16J 15/0825 | 277/627 |

* cited by examiner

*Primary Examiner* — Christine Skubinna
(74) *Attorney, Agent, or Firm* — Troutman Sanders LLP; Ryan A. Schneider; Christopher C. Close, Jr.

(57) ABSTRACT

Aspects of the present disclosure relate to a safety mechanical barrier for use with a ladder for an above-ground swimming pool that is easy to install and provides safety from children accessing the pool via the ladder. Certain aspects of the present disclosure relate to a safety mechanical barrier that blocks access to the ladder itself, thereby restricting access to an above-ground pool by unsupervised minors.

14 Claims, 9 Drawing Sheets

SAFETY MECHANICAL BARRIER AND SYSTEM FOR ABOVE-GROUND POOL LADDERS

CROSS REFERENCE TO RELATED APPLICATIONS

This application claims the benefit under 35 USC 119(e) of U.S. Provisional Patent Application No. 62/089,495, entitled "SAFETY MECHANICAL BARRIER AND SYSTEM FOR ABOVE-GROUND POOL LADDERS," filed Dec. 9, 2014, the entirety of which is fully incorporated herein by reference.

BACKGROUND OF THE INVENTION

1. Field of the Invention

Embodiments of the present invention relate to a pool ladder safety system for above-ground pools (AGPs) and, more specifically, to a safety system for blocking access to the steps of an above-ground pool ladder.

2. Background of the Art

Above-ground swimming pools (AGPs) are known in the art. The most common types of AGPs are constructed of steel, resin, plastic, or other materials. AGPs generally are constructed using a perimeter frame, of various designs, with a heavy plastic, vinyl, or fabric liner to contain water. AGPs may also be collapsible to enable convenient storage.

In-ground pools provide easy access because they are, by definition, at the level of the ground around them. One can simply step off of the pool deck and into the in-ground pool, though steps or a ladder are often provided. Therefore, with an in-ground pool one has only to lower themselves into the water.

Most AGPs, however, are constructed entirely above-ground. In other words, a suitably level site is chosen and the pool is assembled and filled in place. Accordingly, accessing an AGP can become a challenge. The frame provided with an AGP often is designed only to retain the shape of the liner and provide structural support. Thus, the frame may lack the structural rigidity for use as a method to enter the pool. Further, many would find it inconvenient, if not impossible, to climb into an above-ground pool using only the frame, regardless of structural considerations.

Accordingly, to access an AGP, a ladder, deck, or other apparatus often must be provided to allow the user to first climb up to the level of the pool and aid ingress and egress. The sides of an AGP generally are not sufficiently rigid to support the ladder. Thus, the ladder must be supported by the pool deck, which itself is free-standing, or the ladder must be a self-supporting A-frame-type ladder. Traditional A-frame-type ladders generally rest on the bottom of the pool on one side, and on the ground upon which the AGP is assembled and filled on the other. Accordingly, the steps or rungs on the outside of the AGP that provide ingress into and egress out of the AGP are exposed and easily accessible. In particular, the ladder is accessible to children or inexperienced swimmers who may gain unsupervised access to the pool, which can lead to a life-threatening situation.

Thus, it would be desirable to develop an improved mechanical barrier for AGP pool ladders that is easy and convenient to install while being difficult for a child or minor to operate. It is to the foregoing that the present disclosure is primarily directed.

BRIEF DESCRIPTION OF THE DRAWINGS

Various features and advantages of the present disclosure may be more readily understood with reference to the following detailed description taken in conjunction with the accompanying drawing sheets.

DETAILED DESCRIPTION

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose. As used herein, the term "pool" shall refer to and include any above-ground or free-standing swimming pool, spa, water tank, or other above-ground liquid containment enclosure. Further, as used herein, the term "ladder" shall refer to any structure comprising rungs, steps, or other means for providing ingress or egress to or from a pool.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the exemplary embodiments. Such other materials not described herein can include, but are not limited to, materials that are developed after the time of the development of the invention, for example.

Figure 1:
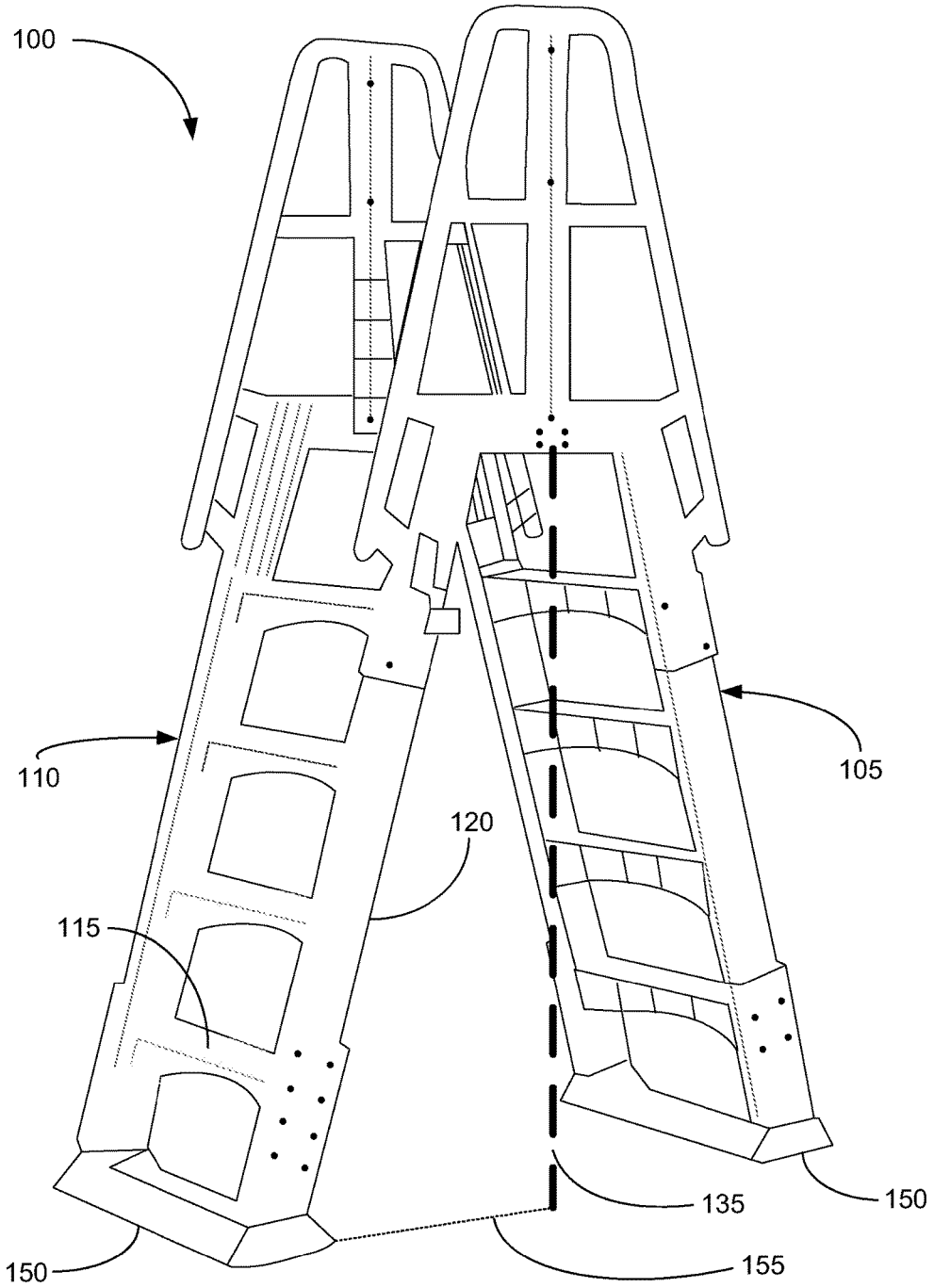
FIG. 1 PRIOR ART
FIG. 1 is a perspective view of a conventional A-frame-type above-ground pool ladder.

Referring now to the figures, FIG. 1 depicts a conventional A-frame type above-ground pool (AGP) ladder 100. Mounting a ladder to the sidewall of an AGP pool can be undesirable, or impossible, due to the construction of AGPs. For example, AGP frames often are constructed to support the liner and retain the liner's shape but are not sufficiently strong to support a ladder. Ladders for AGPs, therefore, tend to be free-standing A-frame-type ladders 100. Ladder 100 can comprise outer ladder 110 resting on foot 150 on the ground outside the pool, which is represented in FIG. 1 by dotted line 155. Outer ladder 110 can be in communication near its top with inner ladder 105, forming A-framed ladder 100. Similar to outer ladder 110, inner ladder 105 can rest on foot 150 on the bottom of the pool.

Both outer ladder 110 and inner ladder 105 may comprise a plurality of rungs 115 and vertical rails or stiles 120. While rungs 115 shown in FIG. 1 are depicted as being substantially flat (akin to step treads), rungs 115 may be substantially tubular in shape or be other suitable shapes. Further, while vertical rails 120 shown in FIG. 1 are depicted as having a rectangular shape (similar to a two-by-four), vertical rails 115 may likewise be substantially tubular in shape or be other suitable shapes.

As discussed, because such A-frame-type ladders are supported outside the pool by the ground 155, the ladder may provide easy pool access to unsupervised children or others who are not able to swim. This easy access can create a dangerous situation as an unsupervised child can use the easily accessible rungs 115 to climb the ladder 100 and enter the pool. In such a case, the possibility for injury and/or death may be imminent.

Figure 2:
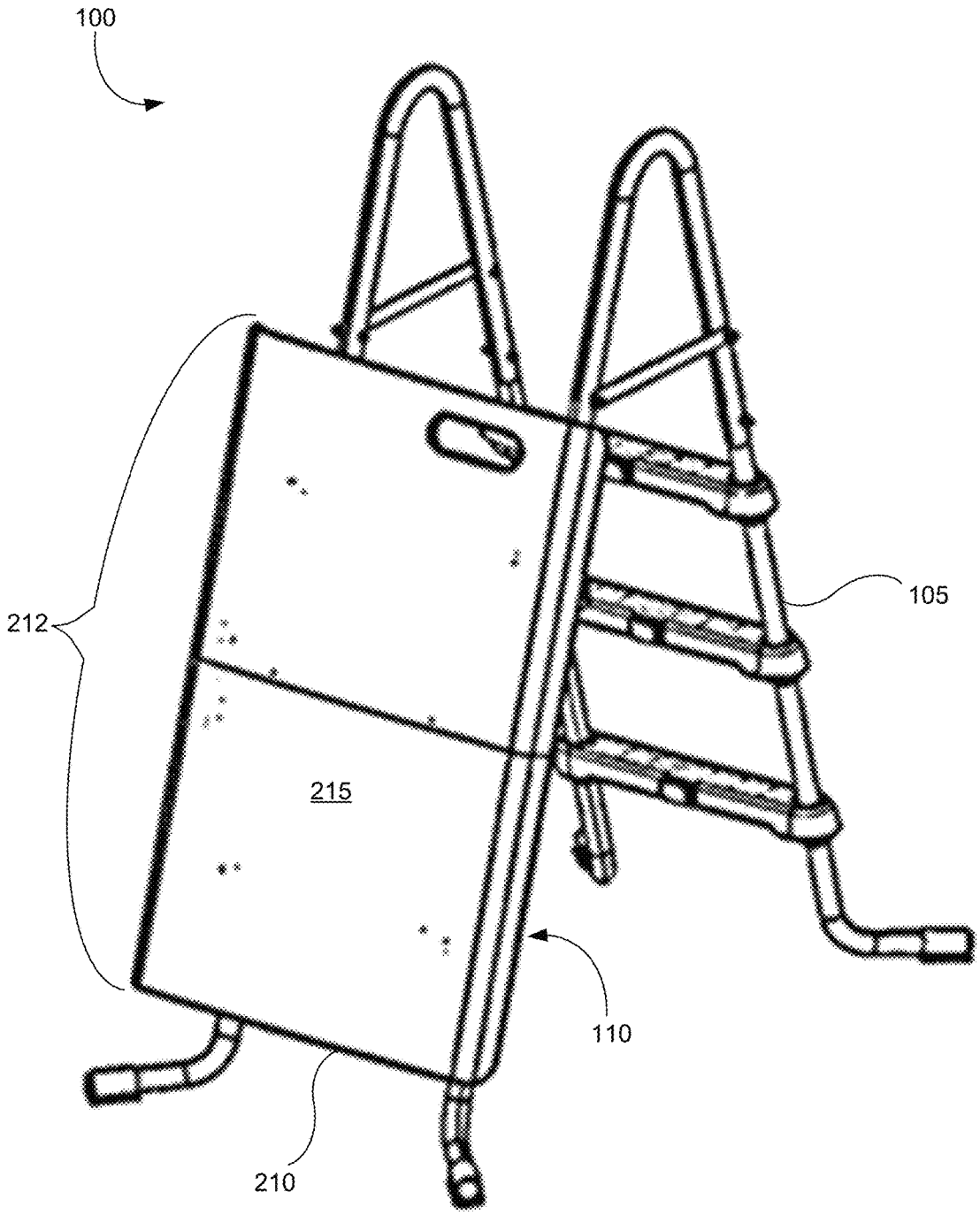
FIG. 2 is a perspective view of a safety mechanical barrier installed on an A-frame-type above-ground pool ladder, according to an exemplary embodiment of the present disclosure.

FIG. 2 illustrates safety mechanical barrier (SMB) 210, according to some embodiments of the present disclosure. Alternatively, SMB 210 may be referred to as a "rung guard," "ladder guard," or "ladder door." As shown in FIG. 2, in some embodiments, SMB 210 may be installed onto A-frame-type pool ladder 100 comprising inner ladder 105, which may be positioned within the perimeter of the pool, and outer ladder 110, which may be positioned outside the perimeter of the pool. In some embodiments, SMB 210 comprises panel 212, which comprises outer surface 215 and inner surface 315 (shown in FIG. 3). As shown in FIG. 2, SMB 210 is in a closed position with outer surface 215 facing outward and inner surface (not shown) facing the rungs of outer ladder 110. According to some embodiments, when in a closed position, SMB 210 can occupy space generally directly in front of the rungs of outer ladder 110. Accordingly, as will be understood and appreciated, SMB 210 can help prevent a child or anyone else from using the rungs of ladder 100 to climb into the pool.

Figure 3:
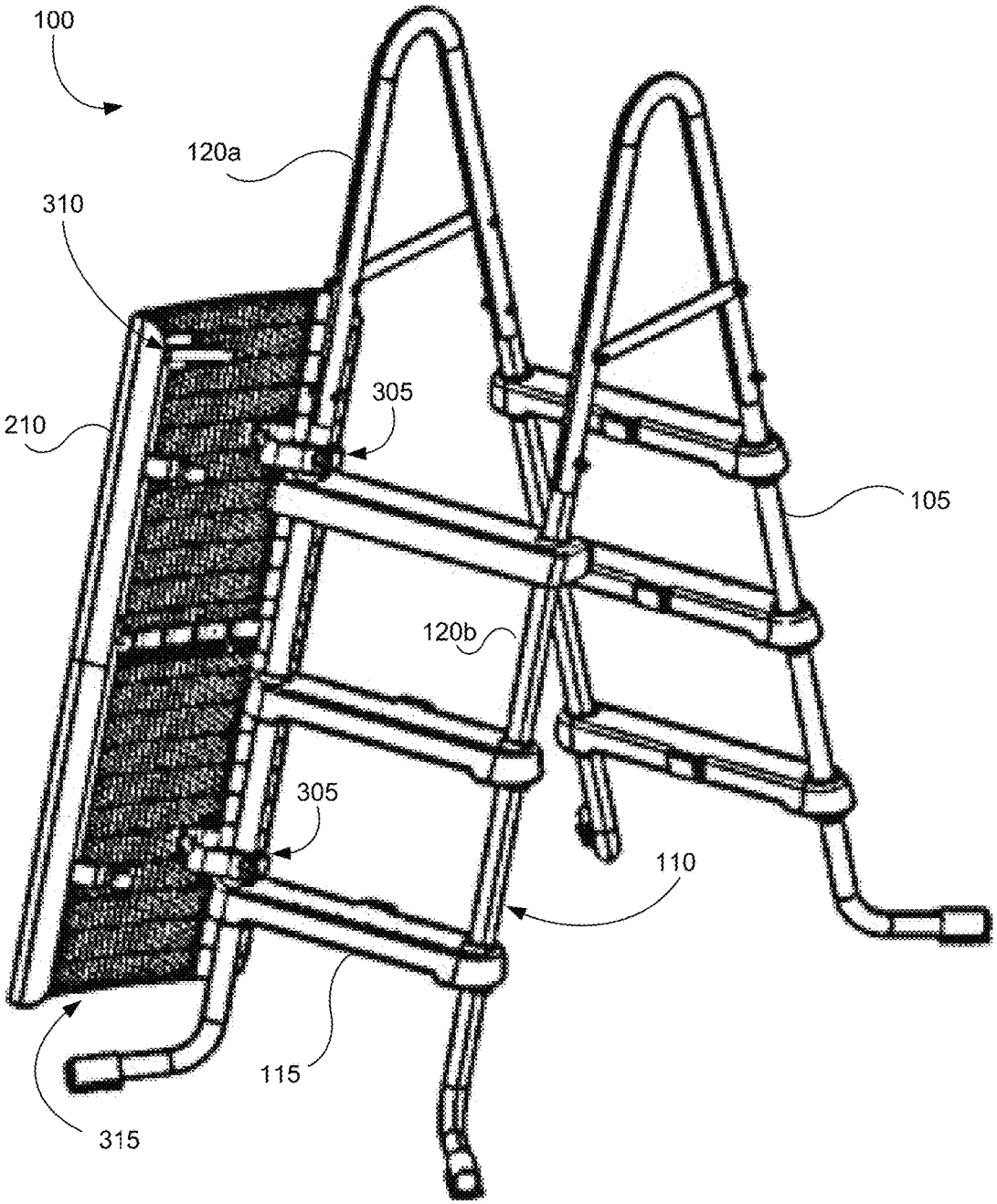
FIG. 3 is another perspective view of a safety mechanical barrier installed on an A-frame-type above-ground pool ladder with the safety mechanical barrier in an open position, according to an exemplary embodiment of the present disclosure.

FIG. 3 is another perspective view of SMB 210 installed on outer ladder 105 of A-frame-type pool ladder 100. As shown in FIG. 3, SMB 210 is in an open position. Accordingly, rungs 115 of outer ladder 110 are exposed to allow a user to enter or exit the pool and SMB 210 is positioned away from rungs 115. As shown in FIG. 3 and as will be discussed further herein, in some embodiments, SMB 210 may attach to and pivot around vertical rail 120*a* via one or more attachment mechanisms 305. As will be understood and appreciated, in some embodiments, attachment mechanism 305 for use in an embodiment of the present disclosure allows for easy installation of SMB 210 onto ladder 100 while also securely connecting SMB 210 onto ladder 100. Further, though FIG. 3 shows attachment mechanisms 305 attached to vertical rail 120*a*, it will be understood that in some embodiments, attachment mechanisms 305 can attach to vertical rail 120*b* in which case SMB 210 pivots around vertical rail 120*b*.

In some embodiments, panel 212 of SMB 210 can be constructed from a resilient material compatible with the pool environment, such as, for example and not limitation, nylon, polyester, canvas, an outdoor performance material (e.g., Sunbrella®), or other suitable material. In alternate embodiments, SMB 210 can be constructed from a rigid material such as metal, plastic, or other suitable material. According to some embodiments, attachment mechanism 305 can be molded directly into SMB 210. For instance, in some embodiments, attachment mechanism 305 can be a molded aperture. For example, attachment mechanism 305 can be a molded tube through which vertical rail 120*a* can be inserted. In other embodiments, attachment mechanism 305 can be molded U-shaped channels capable of snapping over or securely receiving vertical rail 120*a* of outer ladder 110. Such U-shaped channels can securely, yet removably, attach SMB 210 to outer ladder 110. In yet other embodiments, as discussed, the attachment mechanism 305 can be a c-style clamp, a collar-style clamp, a split collar clamp, or a quick release clamp for removably affixing SMB 210 to outer ladder 110. As will be understood, in such configurations, one or more attachment mechanism 305 is in mechanical communication with vertical rail 120*a* and detachably attaches SMB 210 to vertical rail 120*a*.

In some embodiments, SMB 210 may comprise a latching mechanism 310 for locking or securing SMB 210 in a closed position when ladder 100 is not in use. For example, in some embodiments, latching mechanism 310 may fix and lock onto vertical rail 120*b*, which is opposite vertical rail 120*a* to which attachment mechanism 305 engages. In some embodiments, latching mechanism 310 may be configured such that the component used for disengaging latching mechanism 310 (e.g., a knob or handle) is at an elevation sufficiently out of the reach of children or infants. For example, a knob or handle for disengaging latching mechanism 310 may be positioned near a top corner of SMB 210.

Figure 4:
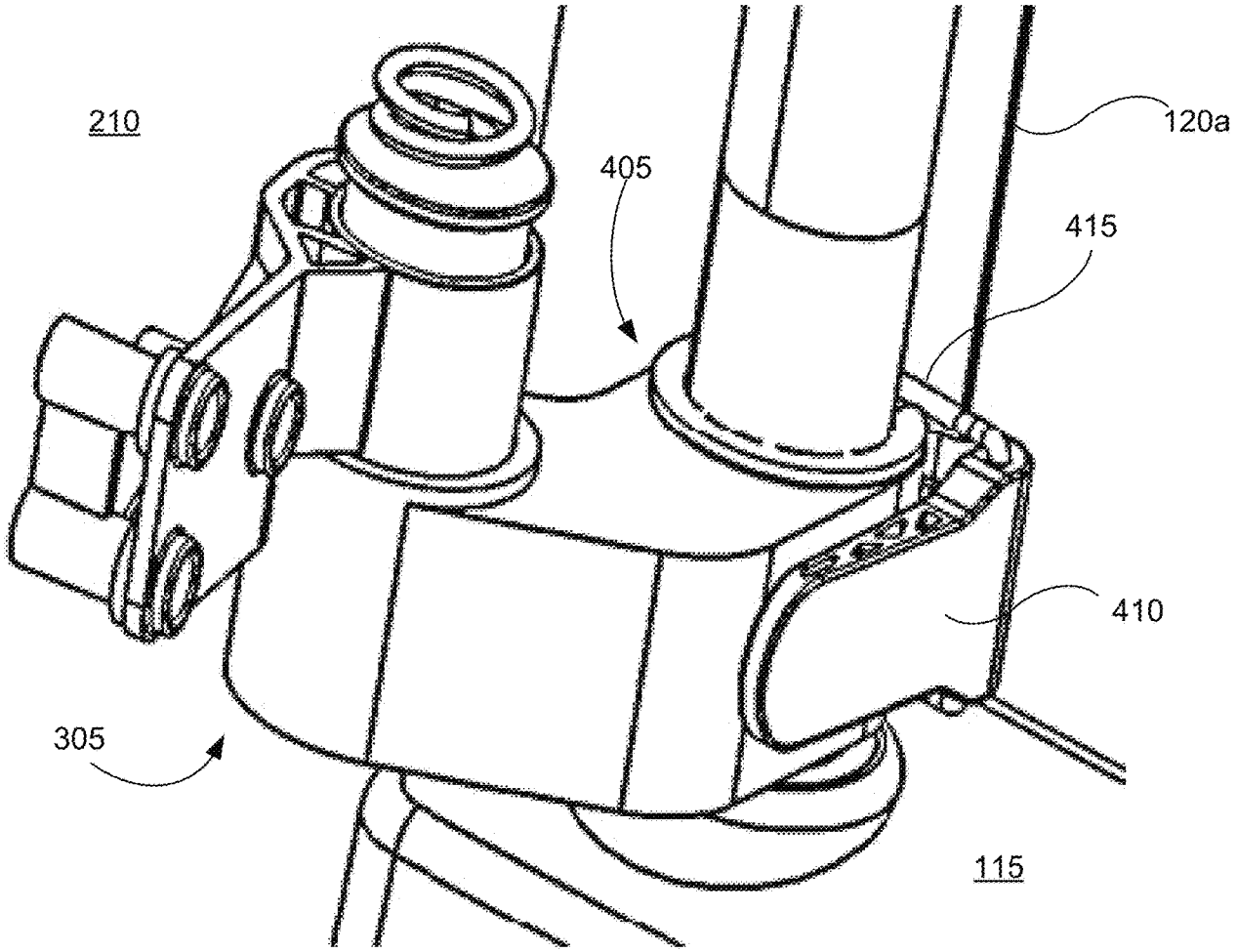
FIG. 4 is a detailed view of an attachment mechanism, according to an exemplary embodiment of the present disclosure.

FIG. 4 is a detailed view of an exemplary attachment mechanism 305, according to some embodiments of the present disclosure. As shown in FIG. 4, in some embodiments, attachment mechanism 305 may comprise quick-release clamp 405 for releasably attaching SMB 210 to vertical rail 120*a* of outer ladder 110. In some embodiments, attachment mechanism may comprise a c-style clamp, a collar-style clamp, a split collar clamp, or other suitable clamp for removably affixing SMB 210 to outer ladder 110. As shown in FIG. 4, according to some embodiments, quick-release clamp 405 may comprise operating member 410 and latch member 415, which may allow easy engagement and disengagement of quick-release clamp 405 to and from vertical rail 210*a*. In some embodiments, in addition to being secured to vertical rail 120*a*, attachment mechanism 305 may be supported by rung 115 of ladder 100. As will be appreciated, supporting attachment mechanism 305 on rung 115 can alleviate downward force on attachment mechanism 305 that can cause stress that causes attachment mechanism 305 to unduly fail.

Figure 5:
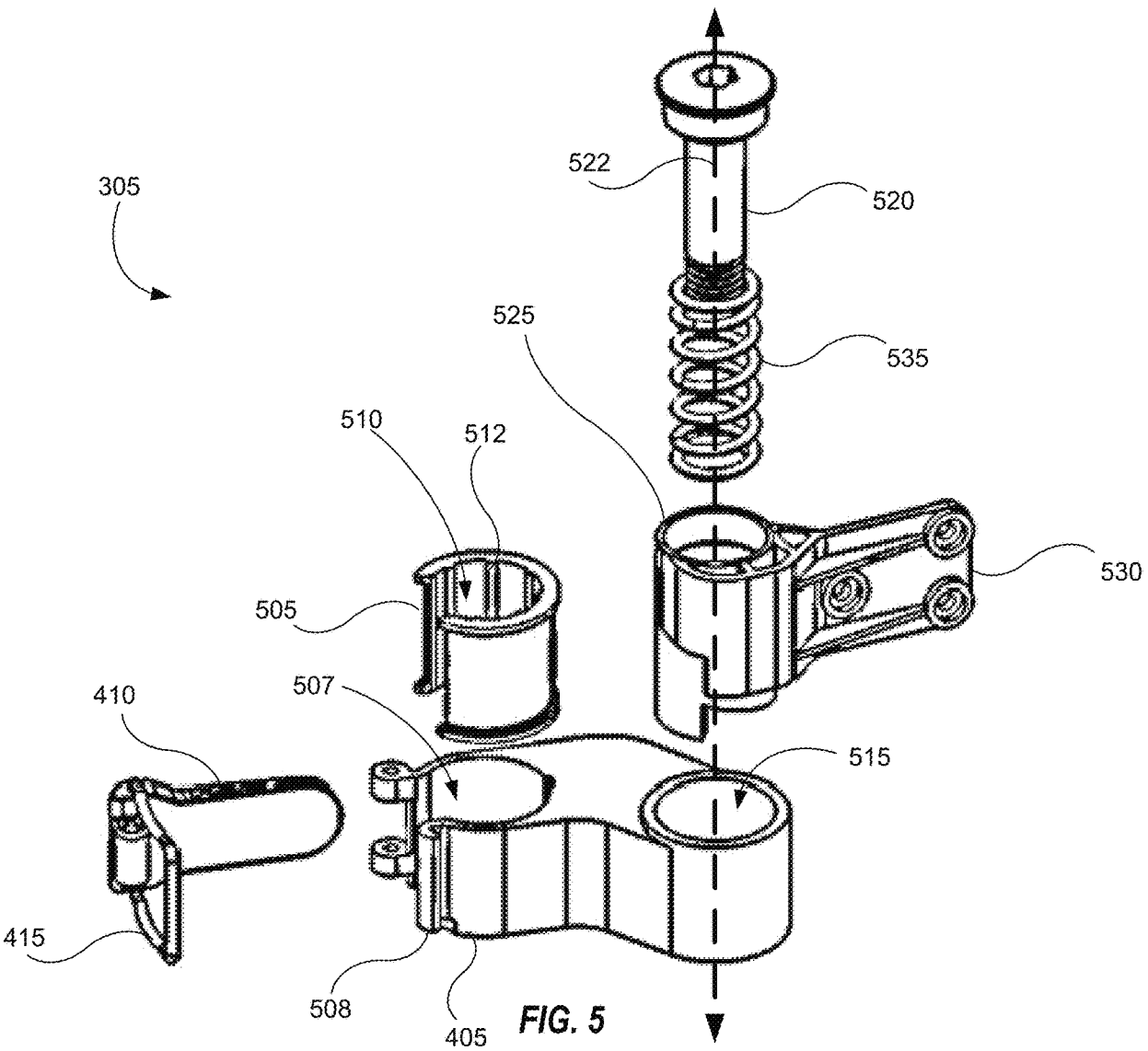
FIG. 5 is an exploded view of an attachment mechanism, according to an exemplary embodiment of the present disclosure.

FIG. 5 is an exploded view of various components that may comprise attachment mechanism 305, according to some embodiments of the present disclosure. As shown in FIG. 5, in some embodiments, attachment mechanism 305 may comprise a quick-release clamp 405 configured to detachably attach SMB 210 with ladder 100. As discussed in relation to FIG. 4, quick-release clamp 405 may be configured to releasably attach SMB 210 to vertical rail 120*a*. Further, as shown in FIG. 5, in some embodiments, quick-release clamp 405 may comprise operating member 410 and latch member 415 that allow for easy engagement and disengagement of quick-release clamp 405 to vertical rail 120. Further, in some embodiments, quick-release clamp 405 may comprise lip 508 with which latch member 415 may engage to provide a secure connection.

Additionally, as shown in FIG. 5, in some embodiments, quick-release clamp 405 may comprise insert cavity 507 configured for receiving insert 505, which may aid in securing quick-release clamp 405 to vertical rail 120*a*. For example, in some embodiments, insert 505 may comprise inner surface 510, which may be coated in a substance that aids in securing quick-release clamp 405 to vertical rail 120*a*. In some embodiments, for example, inner surface 510 may have a rubber surface having a higher coefficient of friction with the material comprising the vertical rail 120*a* than the material comprising quick-release clamp 405. Additionally, inner surface 510 may comprise one or more ridges 512, which may likewise aid in providing a more secure connection to vertical rail 120*a*. Accordingly, as will be understood and appreciated, quick-release clamp 405 used in conjunction with insert 505 may provide for more secure engagement of SMB 210 to ladder 100 than a quick-release clamp 405 having no such insert 505.

As further shown in FIG. 5, in some embodiments, quick-release clamp 405 may comprise vertical cylindrical cavity 515 configured to receive hinge pin 520. Further, in some embodiments, attachment mechanism 305 may comprise hinge eye 525, which may comprise attachment bracket 530 via which SMB 210 can be removably secured to attachment mechanism 305. For example, in some embodiments, SMB 210 can be affixed to attachment mechanism 305 via attachment bracket 530 using an attachment means such as, for example, screws, rivets, or nuts and bolts. In some embodiments, hinge pin 520 can be inserted into hinge eye 525 and cylindrical cavity 515, thereby creating a hinge that allows SMB 210 to pivot around vertical rail 120 such that SMB 210 can be opened (as shown in FIG. 3) and closed (as shown in FIG. 2). Additionally, as shown in FIG. 5, attachment mechanism 305 may further comprise spring 535 having a diameter sufficient to receive hinge pin 520. In some embodiments, spring 535 may be adapted for insertion into hinge eye 525 and cylindrical cavity 515 along with hinge pin 520. Spring 535 may provide a rotating force to SMB 210 which may automatically bring SMB 210 to a closed position (as shown in FIG. 2) when a user releases SMB 210 from an open position. In some embodiments, spring 535 may provide a rotating force to SMB 210 that is sufficient to automatically bring SMB 210 to a closed position when released by a user, but the rotating force provided by spring 535 to SMB 210 is such that it takes sufficient time for SMB 210 to come to a closed position and to allow a user to completely exit ladder 100 and clear themselves from SMB 210. As shown in FIG. 5, in some embodiments, hinge eye 525, cylindrical cavity 515, hinge pin 520, and spring 535 may be brought together such that they substantially align along a vertical axis represented by dashed line 522.

In some embodiments, the rotating force provided by spring 535 may be counteracted by a delaying mechanism to help slow the speed at which SMB 210 automatically closes. As will be appreciated, once SMB 210 is in an open position, it is not necessarily convenient for a user to hold SMB 210 in the open position. For example, if a user is exiting a pool utilizing inner ladder 105, it may not be convenient for the user to open SMB 210 and hold SMB 210 in an open position while the user attempts to exit the pool. Thus, in some embodiments, a mechanism such as a pneumatic door closer may be used to counteract the force provided by spring 535. A pneumatic door closer may be configured such that the force counteracting the rotating force provided by spring 535 is adjustable, thereby allowing a user to adjust the speed with which SMB 210 automatically closes. In some embodiments, a one-way rotary damper may be included to help slow the speed at which SMB 210 automatically closes.

Figure 6:
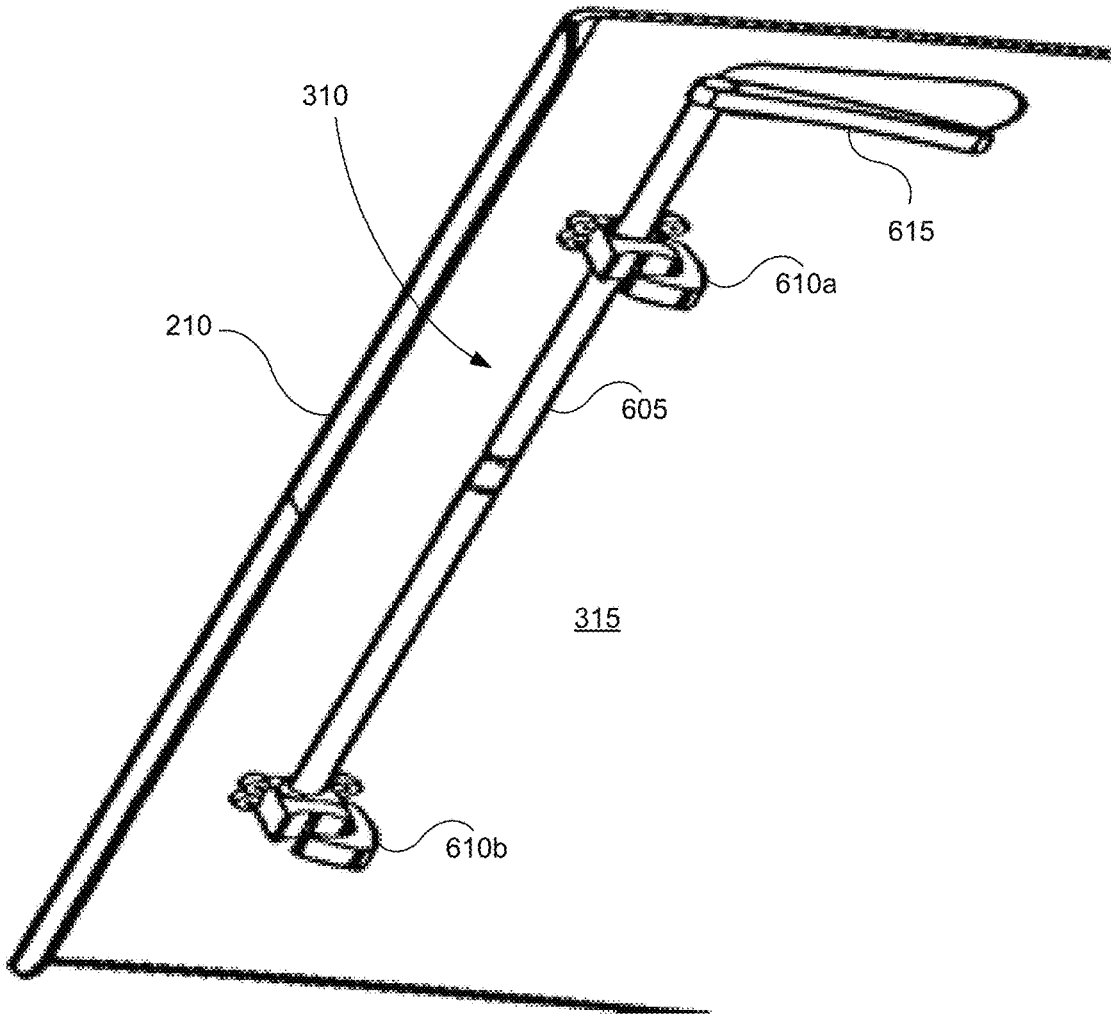
FIG. 6 is a perspective view of the backside of a safety mechanical barrier and latching mechanism, according to an exemplary embodiment of the present disclosure.

FIG. 6 is a perspective view of inside surface 315 of SMB 210 upon which an embodiment of latching mechanism 310 is attached. As shown in FIG. 6, in some embodiments, latching mechanism 310 may comprise elongate member 605 positioned generally parallel to the length of SMB 210 and disposed between clamps 610*a* and 610*b*, which can be configured as a pair for latching SMB 210 to vertical rail 120 of outer ladder 110. In some embodiments, clamps 610*a* and 610*b* are rotatable and thus capable from rotating from an open position to a closed position in which they latch to vertical rail 120. Further, as shown in FIG. 6, in some embodiments, latching mechanism 310 may comprise handle 615 for disengaging latching mechanism 310 from a locked or secured position. Put differently, handle 615 can transition clamps 610*a* and 610*b* from an open position to a closed position, and vice versa. Although shown as a handle 615 in FIG. 6, the mechanism for disengaging latching mechanism 310 from locked or secured position may be configured as a knob or any other suitable configuration. Additionally, in some embodiments, handle 615 may be positioned sufficiently high on SMB 210 such that it is out of reach from children or infants.

Further, in some embodiments, latching mechanism 310 and mechanism for disengaging the latching mechanism (e.g., handle 615) may be configured such that even if it were reached by a child or other potential user, it would be challenging to disengage latching mechanism 310 from ladder 100. For example, in some embodiments, latching mechanism 310 may be configured such that handle 615 must first be lifted vertically (i.e., toward the top of ladder 100) and then rotated to disengage latching mechanism 310. In some embodiments, handle 615 may comprise a trigger mechanism for disengaging latching mechanism 315. Additionally, in some embodiments, latching mechanism 310 may comprise a keyed lock or combination lock that must first be unlocked before latching mechanism 310 can be disengaged.

Figure 7:
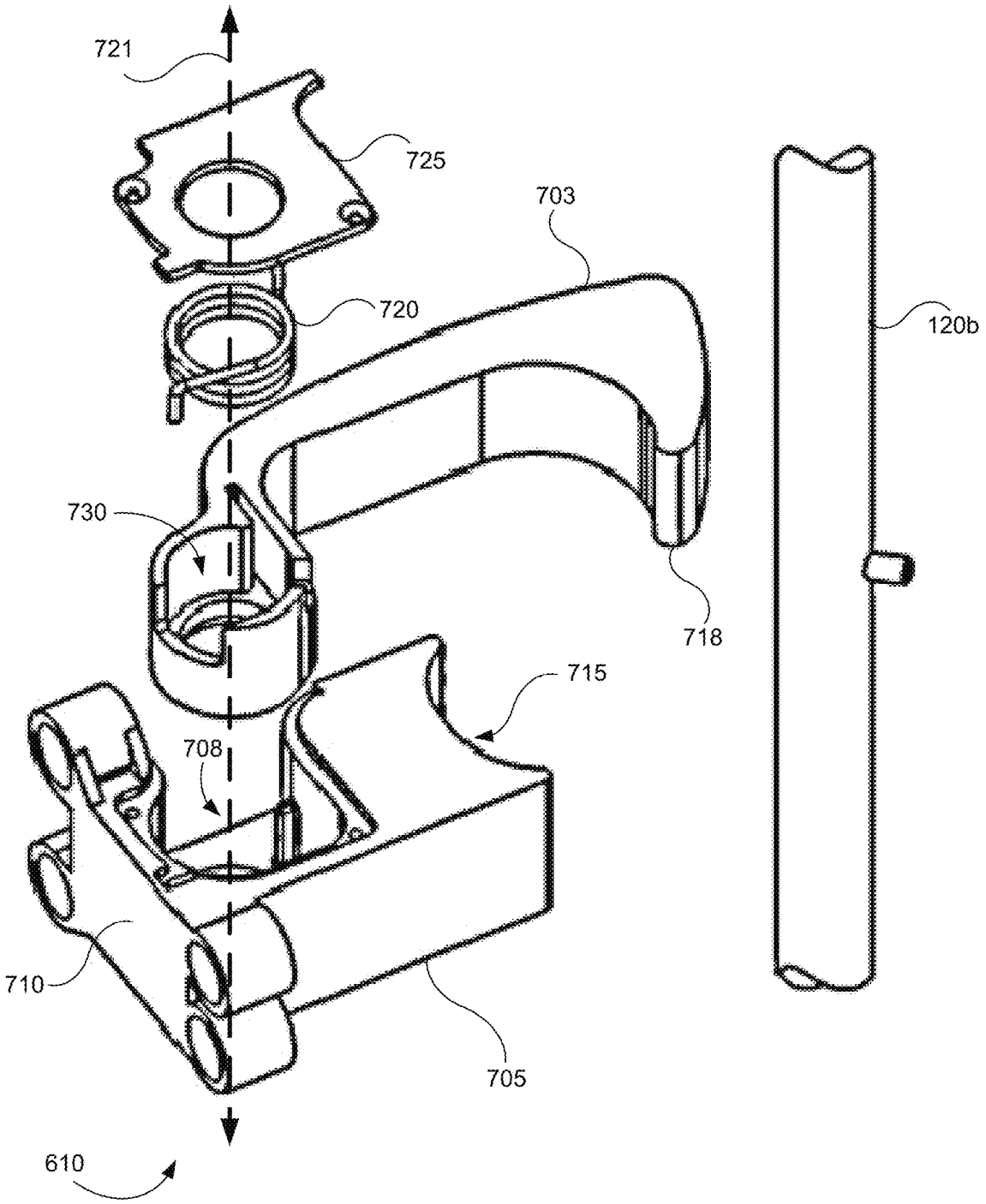
FIG. 7 is an exploded view of a clamp of a latching mechanism, according to an exemplary embodiment of the present disclosure.

FIG. 7 is an exploded view of various components that may compose clamp 610 of latching mechanism 310, according to some embodiments of the present disclosure. As shown in FIG. 7, in some embodiments, clamp 610 may comprise elongate member (e.g., horn) 703 for engaging vertical rail 120*b* to secure or latch SMB 210 to ladder 100. According to some embodiments, clamp 610 may further comprise housing 705, which may be adapted to receive horn 703 via vertical concavity 708 and allow horn 703 to pivot within vertical concavity 708 such that horn 703 can engage and disengage from vertical rail 120*b*.

Housing 705 may further comprise attachment bracket 710 via which SMB 210 can be removably secured to latching mechanism 310. For example, in some embodiments, SMB 210 can be affixed to latching mechanism 310 via attachment bracket 710 using an attachment means such as, for example, screws, rivets, or nuts and bolts. Further, in some embodiments, housing 705 may comprise concave side wall 715 adapted to abut vertical rail 120*b*, thereby allowing latching mechanism 310 to more securely engage vertical rail 120*b* by providing more surface area contact between horn 703 and vertical rail 120*b*. Likewise, horn 703 may comprise extended member 718 adapted to abut vertical rail 120*b* to allow horn 703 to more securely engage vertical rail 120*b*.

As shown in FIG. 7, in some embodiments, clamp 610 may further comprise spring 720 and spring cap 725. According to some embodiments, spring 720 may be adapted for placement within vertical concavity 730 of horn 703, and spring cap 725 may be adapted to enclose spring 720 within vertical concavity 730 of horn 703 and to affix to housing 705. In some embodiments, spring 720 may provide a rotating force that may automatically bring horn 703 into a closed or latched position when a user releases, via handle 615, horn 703 from an open position. For example, after using handle 615 to disengage latching mechanism 310, which may cause elongate member 703 to move into an open position, spring 720 may cause horn 703 to return to a closed position upon release of handle 615 by the user. As further shown in FIG. 7, spring cap 725, spring 720, vertical concavity 730, vertical concavity 708, and substantially align along vertical axis 721 to which elongate member 605 is parallel.

Figure 8:
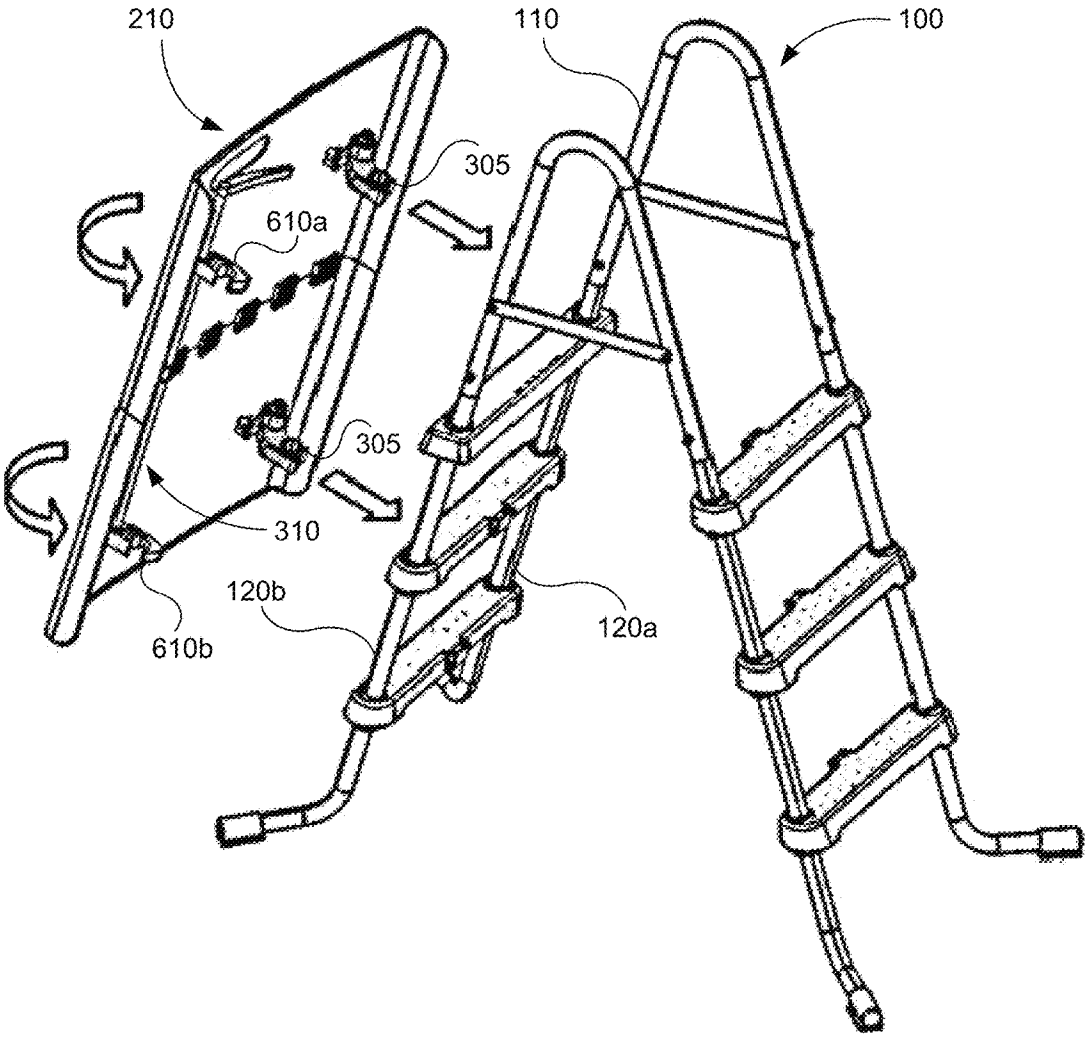
FIG. 8 illustrates a method for installing a safety mechanical barrier to an A-frame-type ladder, according to an exemplary embodiment of the present disclosure.

FIG. 8 illustrates a method for installing an embodiment of SMB 210 onto exterior ladder 110 of A-framed ladder 100. As shown in FIG. 8, in some embodiments, attachment mechanisms 305*a* and 305*b* may be configured to securely affix SMB 210 to vertical rail 120*a* of outer ladder 110. Further, attachment mechanisms 305 may be configured to allow SMB 210 to pivot around vertical rail 120*a* such that SMB 210 can be put in open positions (as shown in FIG. 3) and closed positions (as shown in FIG. 2) and various positions in between. Additionally, as shown in FIG. 8, in some embodiments, latching mechanism 310 may comprise clamps 610*a* and 610*b*, which may be adapted for latching SMB 210 to vertical rail 120*b*.

Figure 9:
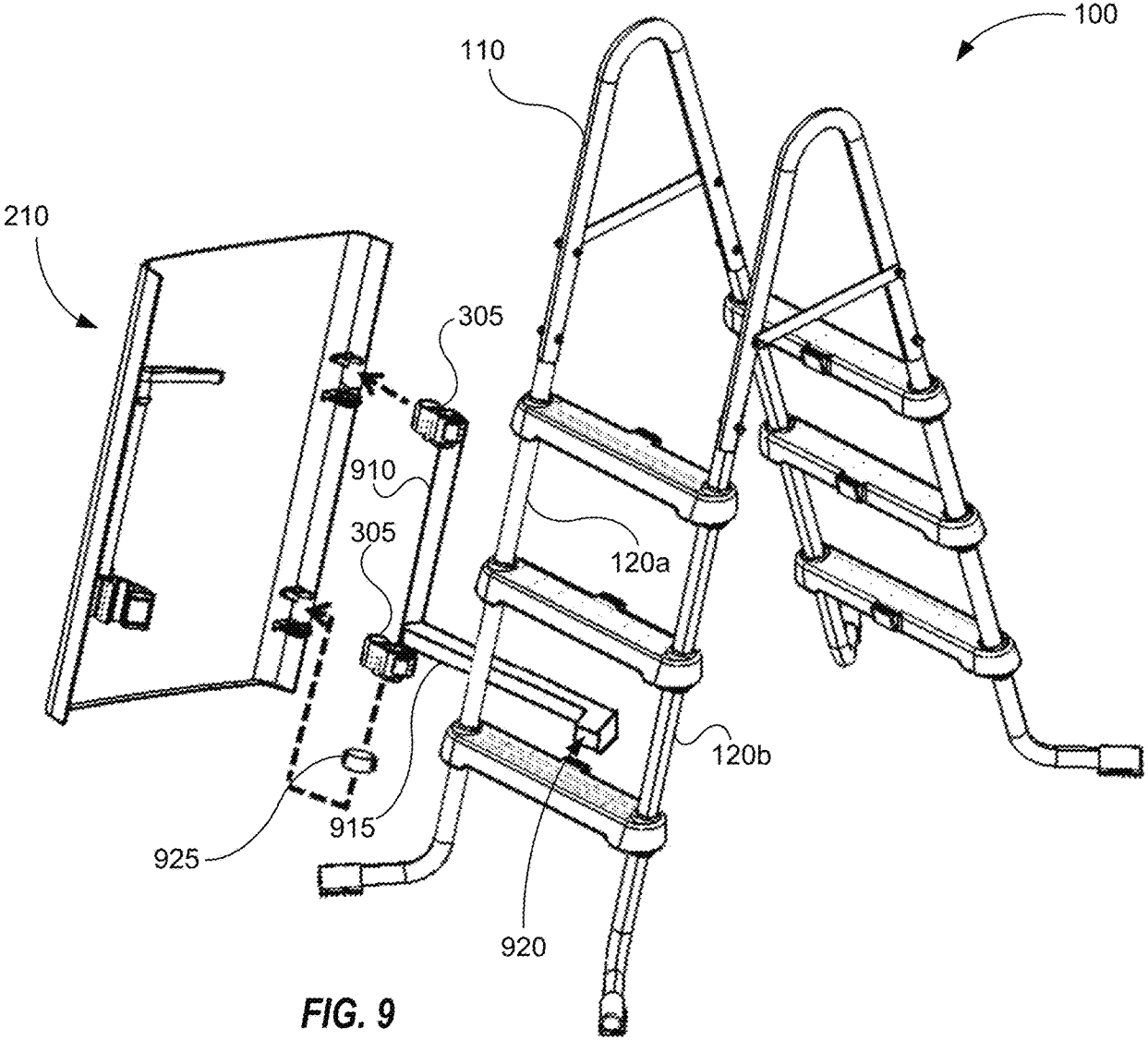
FIG. 9 is a perspective exploded view of a safety mechanical barrier being installed on an A-frame-type above-ground pool ladder, according to an exemplary embodiment of the present disclosure.

FIG. 9 is a perspective exploded view of SMB 210 being installed onto outer ladder 105 of A-frame-type pool ladder 100. As shown in FIG. 9, SMB 210 is in an open position. As previously discussed, in some embodiments, SMB 210 is detachably attachable to vertical rail 120*a* via one or more attachment mechanisms 305, which allows SMB 210 to pivot around vertical rail 120*a*. As shown in FIG. 9, in some embodiments, attachment mechanisms 305 may be affixed to or detachably attached to vertical attachment bracket 910. Extended arm 915 may further extend at a normal angle from vertical attachment bracket 910. Extended arm 915 may be configured to releasably attach to vertical rail 120*b*. For example, in some embodiments, extended arm 915 may comprise a molded channel 920 capable of snapping over or securely receiving vertical rail 120*b*. As will be appreciated, vertical attachment bracket 910 and extended arm 915, which may be referred to collectively as a "structure system," may provide additional rigidity to SMB 210 and help maintain proper alignment between SMB 210 and A-frame-type pool ladder 100 when SMB 210 is in operation. Further, in some embodiments, the structure system may be constructed from steel, resin, plastic, or various other materials.

As shown in FIG. 9, in some embodiments, attachment mechanism 305 may comprise one-way rotary damper 925. For example, in some embodiments, one-way rotary damper 925 may be adapted for insertion into cylindrical cavity 515 and/or hinge eye 525 (as shown in FIG. 5). In some embodiments, one-way rotary damper 925 may provide a force that counters SMB 210 as SMB 210 transitions from an open position to a closed position. Further, in some embodiments, one-way rotary damper 925 may comprise an aperture sufficient to receive hinge pin 520. Accordingly, as will be appreciated, one-way rotary damper 925 may slow the speed at which SMB 210 transitions from open to closed positions, which can allow a user time to safely exit outer ladder 105 before SMB 210 closes. In some embodiments, the speed at which SMB 210 transitions from open to closed positions may be predetermined, and one-way rotary damper 925 may be configured to provide sufficient force such that SMB 210 closes at the predetermined rate.

It will be apparent to those skilled in the art that many modifications, additions, and deletions can be made to the embodiments presented herein without departing from the spirit and scope of the disclosure. For example, while disclosed for use with a ladder for an above-ground pool, the safety mechanical barrier can readily be adapted for use with other ladders. The materials and configurations disclosed herein are intended to serve illustrative and explanatory purposes only and should not be construed, in any way, as a limitation to the present disclosure.

What is claimed is:

1. A safety mechanical barrier having a length and including a panel comprising an outer surface and an inner surface, the safety mechanical barrier comprising:

at least one attachment mechanism adapted for attaching the safety mechanical barrier to a first vertical rail of a pool ladder and for allowing the safety mechanical barrier to rotate around the first vertical rail when attached to the first vertical rail, the at least one attachment mechanism coupled to the safety mechanical barrier, the at least one attachment mechanism comprising:

a hinge bracket having a hinge eye, the attachment mechanism being coupled to the inner surface of the safety mechanical barrier via the hinge bracket;

a hinge pin having a vertical axis; and a spring having a vertical axis and diameter sufficient to receive the hinge pin; and a latching mechanism comprising a rotatable first clamp and a rotatable second clamp configured for latching the safety mechanical barrier to a second vertical rail of the pool ladder when the safety mechanical barrier is in a closed position, the second vertical rail parallel to and opposite from the first vertical rail of the pool ladder, wherein the hinge pin is inserted into the spring such that the hinge pin vertical axis and spring vertical axis are substantially aligned, wherein the hinge eye and the vertical cylindrical cavity are adapted to receive the hinge pin and the spring, and wherein, when inserted into the hinge eye and the vertical cylindrical cavity, the spring provides a rotating force sufficient to bring the safety mechanical barrier from an open position to a closed position.

2. The safety mechanical barrier of claim 1, wherein the panel is constructed from a material chosen from the group comprising nylon, polyester, canvas, and outdoor performance material.

3. The safety mechanical barrier of claim 1, wherein the at least one attachment mechanism comprises a c-style clamp, collar-style clamp, split-collar clamp, or quick-release clamp configured to mechanically couple the safety mechanical barrier to the first vertical rail of the pool ladder.

4. The safety mechanical barrier of claim 1, wherein the attachment mechanism comprises a quick-release clamp having an operating member and latch member.

5. The safety mechanical barrier of claim 4, wherein the quick-release clamp further comprises:

an insert having an inner surface comprising a coating to aid in securing the mechanical safety barrier to the first vertical rail; and an insert cavity configured to receive the insert.

6. A safety mechanical barrier having a length and including a panel comprising an outer surface and an inner surface, the safety mechanical barrier comprising:

at least one attachment mechanism adapted for attaching the safety mechanical barrier to a first vertical rail of a pool ladder and for allowing the safety mechanical barrier to rotate around the first vertical rail when attached to the first vertical rail, the at least one attachment mechanism coupled to the safety mechanical barrier, the at least one attachment mechanism comprising:

a vertical cylindrical cavity;

a hinge pin; and a one-way rotary damper having an aperture sufficient to receive the hinge pin; and a latching mechanism comprising a rotatable first clamp and a rotatable second clamp configured for latching the safety mechanical barrier to a second vertical rail of the pool ladder when the safety mechanical barrier is in a closed position, the second vertical rail parallel to and opposite from the first vertical rail of the pool ladder, wherein the vertical cylindrical cavity and the aperture are substantially aligned and adapted to receive the hinge pin, and wherein, when inserted into the vertical cylindrical cavity and the aperture, the one-way rotary damper provides a force sufficient to cause the safety mechanical barrier to transition from an open position to a closed position at a predetermined rate.

7. The safety mechanical barrier of claim 1, wherein the at least one attachment mechanism is molded onto the surface of the safety mechanical barrier.

8. The safety mechanical barrier of claim 7, wherein the at least one attachment mechanism molded onto the surface of the safety mechanical barrier is a molded aperture through which the first vertical rail can be inserted.

9. The safety mechanical barrier of claim 7, wherein the at least one attachment mechanism molded onto the inner surface of the safety mechanical barrier is a U-shaped channel adapted for securely receiving the first vertical rail.

10. The safety mechanical barrier of claim 1 further comprising a structure system comprising:

a vertical attachment bracket; and an extended arm affixed to and extending at a normal angle from the vertical attachment bracket, the extended arm comprising a molded channel adapted for securely receiving the second vertical rail at a position separate from the latching mechanism, wherein the at least one attachment mechanism is affixed to the vertical attachment bracket.

11. The safety mechanical barrier of claim 1, wherein the latching mechanism further comprises:

an elongate member having a first end and a second end, the elongate member positioned generally parallel to length of the safety mechanical barrier, and attached to and at least partially disposed between the first clamp and the second clamp; and a handle disposed at the first end of the elongate member, the handle configured to transition the latching mechanism to and from an open position and a closed position.

12. A safety mechanical barrier having a length and including a panel comprising an outer surface and an inner surface, the safety mechanical barrier comprising:

at least one attachment mechanism adapted for attaching the safety mechanical barrier to a first vertical rail of a pool ladder and for allowing the safety mechanical barrier to rotate around the first vertical rail when attached to the first vertical rail, the at least one attachment mechanism coupled to the safety mechanical barrier; and a latching mechanism comprising a rotatable first clamp and a rotatable second clamp configured for latching the safety mechanical barrier to a second vertical rail of the pool ladder when the safety mechanical barrier is in a closed position, the second vertical rail parallel to and opposite from the first vertical rail of the pool ladder, wherein the latching mechanism further comprises:

an elongate member having a first end and a second end, the elongate member positioned generally parallel to length of the safety mechanical barrier, and attached to and at least partially disposed between the first clamp and the second clamp; and a handle disposed at the first end of the elongate member, the handle configured to transition the latching mechanism to and from an open position and a closed position; and wherein the first and second clamps each comprise:

a horn having an extended member and a horn vertical concavity, wherein the extended member is adapted to abut the second vertical rail to allow the horn to securely engage the second vertical rail when the horn is in a closed position;

a housing having a housing vertical concavity, the housing adapted to receive the horn inside the housing vertical concavity and allow the horn to pivot around a vertical axis;

a spring positioned inside the horn vertical concavity; and a spring cap affixed to the housing, wherein the spring cap encloses the spring inside the horn vertical cavity and the horn inside the housing vertical cavity, wherein the spring cap, the spring, the horn vertical cavity, and the housing vertical cavity are disposed around a portion of the elongate member and are substantially aligned along a vertical axis to which the elongate member is substantially parallel, and wherein the spring is disposed within the horn vertical cavity, and the spring provides a rotating force sufficient to bring the horn from an open position to a closed position.

13. The safety mechanical barrier of claim 1, wherein the at least one attachment mechanism is coupled to the inner surface of the safety mechanical barrier.

14. The safety mechanical barrier of claim 1, wherein the at least one attachment mechanism is adapted for releasably attaching the safety mechanical barrier to the first vertical rail of the pool ladder.

* * * * *